United States Patent [19]

Marling

[11] 4,258,856

[45] Mar. 31, 1981

[54] SPACE DIVIDING ASSEMBLY

[76] Inventor: Douglas S. Marling, 2511 Elizabeth St., Janesville, Wis. 53545

[21] Appl. No.: 944,861

[22] Filed: Sep. 22, 1978

[51] Int. Cl.[3] ..... B65D 1/36; B65D 6/06

[52] U.S. Cl. ..... 220/22.3; 24/73 PC; 52/239; 52/285; 217/7; 312/111

[58] Field of Search ..... 220/20, 22, 23.4, 22.3; 217/7, 30, 12 R, 65, 69, 70, 18, 22; 24/73 PC; 211/184; 312/140.3, 140.4, 330 R, 330 SM, 111, 140; 108/61, 59, 60; 52/285, 239

[56] References Cited

U.S. PATENT DOCUMENTS

| | | | |
|---|---|---|---|
| 397,012 | 1/1889 | Lyons | 211/184 |
| 960,934 | 6/1910 | Hunter | 312/140 |
| 1,048,566 | 12/1912 | Miller | 217/18 |
| 1,620,737 | 3/1927 | Peterson | 24/73 PC X |
| 1,863,381 | 6/1932 | Orthwine | 217/65 X |
| 2,343,936 | 3/1944 | Showers | 217/7 X |
| 2,549,509 | 4/1951 | Munroe | 217/12 R |
| 2,825,614 | 3/1958 | Card | 312/111 |
| 3,140,791 | 7/1964 | Reiss, Sr. et al. | 217/7 |
| 3,225,952 | 12/1965 | Stiles | 217/65 |
| 3,680,177 | 8/1972 | Ginsberg | 24/73 PC |
| 3,702,520 | 11/1972 | Huber et al. | 52/284 |
| 3,913,289 | 10/1975 | Recker | 52/285 |
| 4,118,903 | 10/1978 | Coulthard | 52/285 X |

FOREIGN PATENT DOCUMENTS

| | | | |
|---|---|---|---|
| 995507 | 12/1951 | France | 52/285 |
| 2308820 | 11/1976 | France | 312/140 |

*Primary Examiner*—Allan N. Shoap

*Attorney, Agent, or Firm*—Larson, Taylor and Hinds

[57] ABSTRACT

A space dividing assembly is provided for dividing an existing drawer into smaller compartments or for forming a storage drawer, storage unit or the like. The basic building blocks of the assembly are generally flat rectangular runner members having longitudinal slots in the upper and lower edges thereof and connectors for connecting the runner members together. The connectors include T-shaped members having perpendicularly extending flanges which are received in the slots in the runner members and L-shaped corner members which include similar flanges. A "starter" component which secures the runner members to the side walls of an existing drawer includes a back portion which has an adhesive backing and spaced, outwardly extending flanges which are received in the upper and lower slots in a runner member.

11 Claims, 16 Drawing Figures

SPACE DIVIDING ASSEMBLY

FIELD OF THE INVENTION

The invention relates to a space dividing arrangement for dividing the space within existing drawers into smaller compartments as well as in forming drawers or other storage units, and to the drawers and other storage units formed thereby.

BACKGROUND OF THE INVENTION

A number of arrangements are known for dividing an existing drawer into smaller compartments so that, for example, different items can be stored separately. Slotted interfitting partitions of various kinds have been used for this purpose and examples of other arrangements are disclosed in U.S. Pat. Nos. 943,817 (Vick); 2,743,774 (Pinto); 2,614,715 (Ross); 2,082,667 (Vanderveld); 3,227,504 (Dunham); 3,746,181 (Benoit). Other patents of possible interest include U.S. Pat. Nos. 885,814 (Rote) and 261,919 (Gibbons).

Although divider arrangements of the prior art basically serve the purpose for which they are intended, these arrangements offer disadvantages particularly regarding ease of assembly, versatility in providing different compartment shapes and patterns, and flexibility in use.

SUMMARY OF THE INVENTION

In accordance with the invention, a space divider assembly is provided which possesses the advantages discussed above. The assembly is extremely versatile and flexible in use, permitting what is for all practical purposes an infinite number of compartment shapes and patterns while employing only a relatively few components. The elements of the assembly are relatively easy to manufacture and are quite easy to use.

In accordance with a preferred embodiment thereof, the space dividing assembly comprising a plurality of runner members of flat, generally rectangular shape and including longitudinal slots in the upper and lower edges thereof and a plurality of connector members for connecting runner members together to form the space dividing assembly. The connector members including at least two outwardly extending flanges engaging in the slots of juxtaposed ones of said runner members so as to connect said juxtaposed runner members together. At least one of the connector members comprises a substantially T-shaped member comprising a substantially planar T-shaped base having a bar portion and a central leg portion, a first flange extending from the bar portion perpendicularly to the plane of the base, and a second flange extending from the leg portion perpendicularly to the plane of the base and orthogonally to the first flange. The first and second flanges are spaced apart in the area of joindure of the bar portion and the leg portion. At least one further connector member comprises a substantially L-shaped member comprising a substantially planar L-shaped base and first and second flanges extending from respective legs of said base perpendicularly to the plane of the base and orthogonal to each other. The first and second flanges are spaced apart in the area of joindure between the legs of the L-shaped member.

In an embodiment wherein the assembly is disposed in an existing drawer or the like, at least one wall connector component is provided for connecting the ends of the runner member to the inner walls of the drawer.

The wall connector component comprises a backing portion for adhesively securing the component to the wall and a pair of spaced, centrally disposed flanges which engage in the respective slots in a corresponding runner member. The wall connector component preferably includes further flanges which are disposed on opposite sides of the runner adjacent the side walls thereof.

In a further embodiment, the assembly includes a bottom-forming arrangement including a bottom-forming member comprising integral side and bottom portions. The side portion includes a slot in the top edge thereof corresponding to the slot in the runner members and a recess in the lower inside surface thereof. The bottom-forming arrangement further comprising a connector component including a rod portion which is received in said recess in the side portion of said bottom-forming member and a coupling flange secured to said rod portion and engaging in a slot in a said runner member.

In yet another embodiment, a back or bottom member is secured to a plurality of runner members, and the assembly further comprises a connector component comprising a generally L-shaped member comprising a pair of legs, one of the legs including an offset portion therein whose width is substantially equal to the width of the back or bottom member and the other of the legs engaging in one of the slots of a runner member.

According to a further feature of the invention, at least one tray member is provided which includes side walls and a central tray portion. The side walls of the tray member include means defining a coupling slot and the assembly further comprises a U-shaped connector member which engages in said coupling slot and a corresponding one of the slots in a runner member so as to couple the tray member to the runner member. Advantageously, where a plurality of the tray members are provided, the assembly further comprises a U-shaped connector whose legs of are received in the coupling slots of adjacent side walls of two of the tray members so as to connect the two tray members together.

Other features and advantages of the invention will be set forth in, or apparent from, in detailed description of a preferred embodiment found hereinbelow.

DESCRIPTION OF THE PREFERRED EMBODIMENTS

Figure 1:
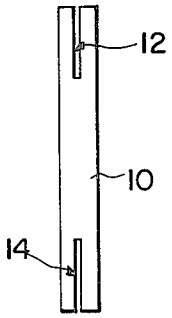
FIG. 1 is an end elevational view of a runner member in accordance with the invention.
Figure 2:
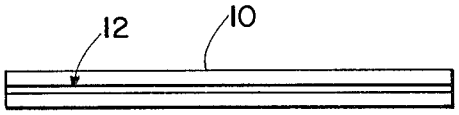
FIG. 2 is a plan view of the runner member of FIG. 1.

Referring to FIGS. 1 and 2, an end elevational and a plan view are provided of a basic runner member, generally denoted 10, which is used in contructing the space dividing assembly of the invention. As illustrated, runner member 10 includes upper and lower longitudinal slots 12 and 14 therein which extend a predetermined distance inwardly from the upper and lower edge surfaces of member 10.

Figure 3:
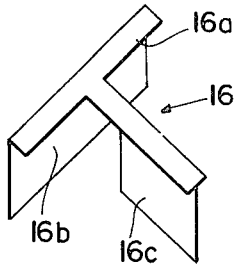
FIG. 3 is a perspective view of a T-connector in accordance with the invention.
Figure 4:
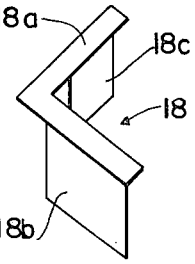
FIG. 4 is a perspective view of an L-connector in accordance with the invention.

Runner members corresponding to member 10 are connected together by connector components illustrated in FIGS. 3 and 4. In FIG. 3, a "perpendicular" or T-shaped connector member 16 is shown which comprises a T-shaped base member 16*a* and a pair of orthogonal flanges 16*b* and 16*c*. Flange 16*b* extends perpendicular to the cross bar of base member 16*a* while flange 16*c* extends perpendicular to the cross bar of base member 16*a* while flange 16*c* extends perpendicular to the central leg of T-shaped base member 16*a* and runs along a portion of the length thereof so as to be spaced from flange 16*b* in the area of joindure of the cross bar and central leg of base member 16*a*.

Referring to FIG. 4, a corner or L-shaped connector member 18 is illustrated which comprises an L-shaped base member 18*a* and a pair of flanges 18*b* and 18*c*. Flanges 18*b* and 18*c* extend perpendicularly to the plane of base member 18*a* and are spaced from the area of joindure of the two legs forming L-shaped base member 18*a*, as illustrated.

Figure 5:
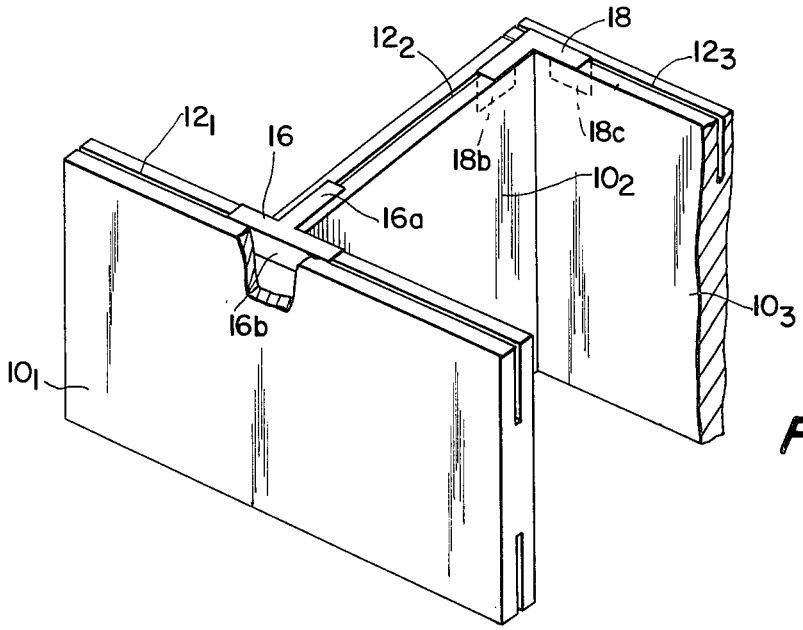
FIG. 5 is a perspective view of a sub-assembly of the space dividing assembly of the invention.

Referring to FIG. 5, a subassembly of runners and connector members is shown which illustrates the function of the various components. As shown, a first runner $\mathbf{10}_1$ is connected to a second runner $\mathbf{10}_2$ at a point intermediate the ends thereof by means of a T-shaped 16 corresponding to that shown in FIG. 3. The elongate bar flange 16*b* is received in an upper slot 12 in runner $\mathbf{10}_1$ and flange 16*c* is received in the end of an upper slot $\mathbf{12}_2$ in runner $\mathbf{10}_2$. Similarly, a connector 18 corresponding that illustrated in FIG. 4 connects the ends of runners $\mathbf{10}_2$ and $\mathbf{10}_3$. It will be understood that the widths of the slots 12 and 14 as compared with the thicknesses of the connector flanges are such that two such flanges can fit in the same part of a slot and thus, for example, two cooperating T-shaped connectors can be used to form a cross-shaped configuration comprising a main wall and oppositely extending walls orthogonal to the main wall.

Figure 6:
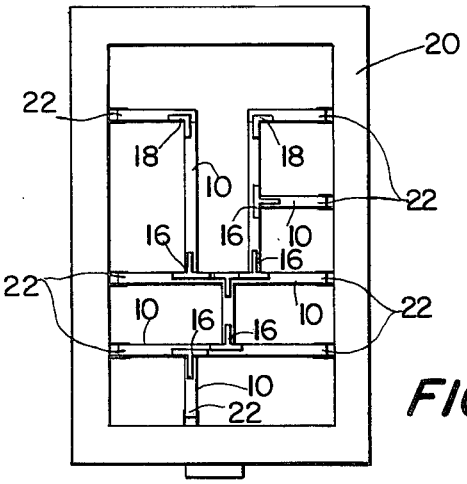
FIG. 6 is a plan view of a first embodiment of the invention.
Figure 7:
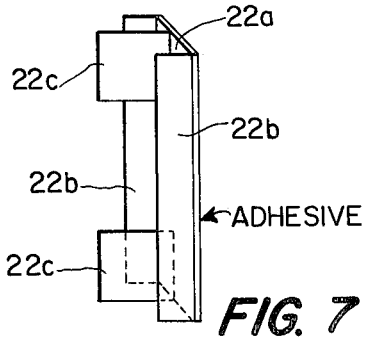
FIG. 7 is a perspective view of a wall connector component used in the embodiment of FIG. 6.

Referring to FIG. 6, a space dividing arrangement built from the components discussed above is used to divide an existing drawer 20. If desired, a connection with the side walls of drawer 20 can be provided utilizing a connector or "starting component" such as shown in FIG. 7. This connector, which is generally denoted 22, includes a base portion 22*a* which has a backing of adhesive and which, in use, extends vertically and engages the inner wall of the drawer. Connector 22 also includes a pair of side flanges 22*b* which extend outwardly from base 22*a* and fit on opposite sides of a runner 10, and first and second centrally located, vertically spaced flanges 22*c* which are adapted to be received in the upper and lower slots 12 and 14, respectively. As shown schematically in FIG. 6, connectors are placed with the adhesive backing against the drawer wall and flanges 22*c* received in runner slots 12 and 14.

Figure 8:
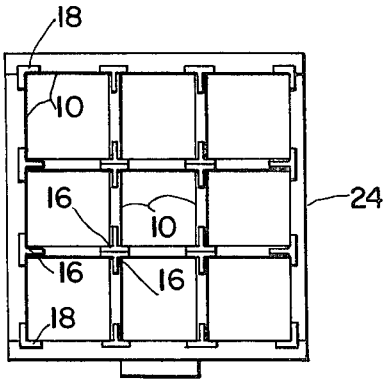
FIG. 8 is a plan view of a further embodiment of the invention.
Figure 9:
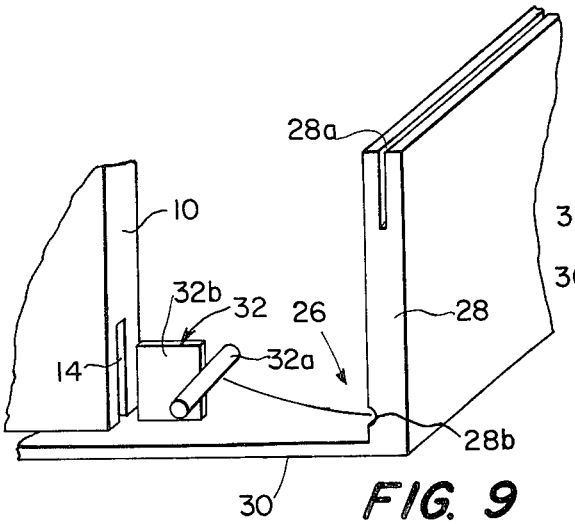
FIG. 9 is a perspective view of a further connector arrangement.

Referring to FIG. 8, a storage drawer unit is illustrated which provides a number of compartments for storing such small items as nuts, bolts, screws and the like. The space divider arrangement of FIG. 8 is similar to that of FIG. 6 and the basic storage drawer unit, which is denoted 24, is formed by a series of runners and connectors corresponding to those discussed above. To provide a bottom for the drawer 24, a construction assembly such as illustrated in FIG. 9 is preferably employed. This assembly, which is generally denoted 26, includes an integral side wall 28 and a planar bottom 30 and a separate connector component 32 for connecting side wall 28 to a runner member 10 which rests on bottom 30. The side wall 28 forms one side wall of the storage drawer and includes a slot 28*a* corresponding to that of the runner members described above while the bottom 30 is forms the bottom of the storage drawer. A semi-circular recess or slot 28*b* formed in side wall 28 is adapted to receive approximately one-half of a rod-shaped portion 32*a* of connector 32. A flange 32*b* extends perpendicularly outwardly from the side wall 28 when rod portion 32*a* is received in slot 28*b*. Flange 32*b* is adapted to engage in a slot 14 of runner so that runner 10 divides the space within the drawer 10 so as to provide coupling with the runner.

Figure 10:
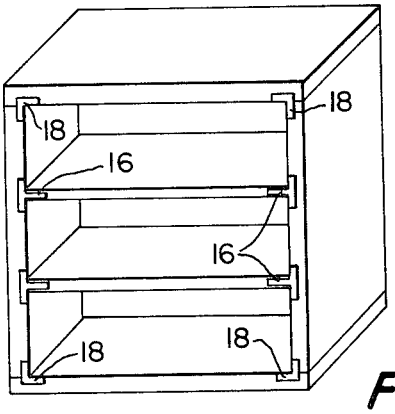
FIG. 10 is a perspective view of a further embodiment of the invention.
Figure 11A:
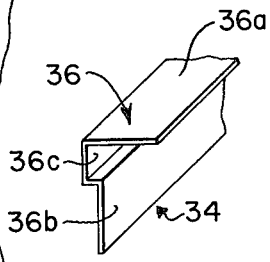
FIGS. 11(*a*) and 11(*b*) are, respectively, a persepctive view of a further connector component and a plan view showing the component in use.
Figure 11B:
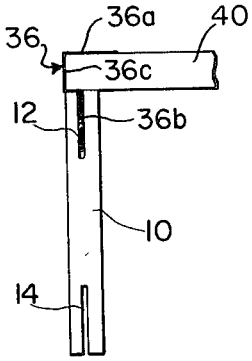

Referring to FIG. 10, an example of an independent storage unit is shown which can be designed by a user to provide divided trays, racks, "pigeon holes" and the like. The unit of FIG. 10 uses T-shaped components 16 and corner components 18 corresponding to those described above, as well as a back or bottom connecting component illustrated in FIGS. 11(*a*) and 11(*b*). As shown in FIG. 11*a*, the connecting component, which is denoted 34, comprises a generally L-shaped member 36 comprising a relatively short leg 36*a*, and a relatively long leg 36*b* which includes an offset portion 36*c* whose width is equal to the width of a back or bottom member and is adapted to receive the abutting end of such a member therein. As illustrated in FIG. 11(*b*), the non-offset portion of leg 36*b* is received in a corresponding slot 12 (or 14) of a runner 10 and, in the illustrative example, a back or bottom member 40 is mounted on the top of the runner member 10 and held in place in offset 36*c* by leg 36*a*.

Figure 12:
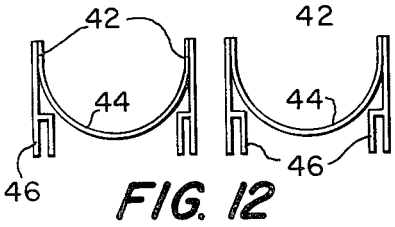
FIGS. 12 and 13 are end elevational views of tray members of the assembly of the invention.
Figure 13:
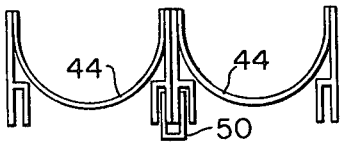
Figure 14:
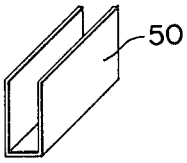
FIG. 14 is a perspective view of a connector used with the tray members of FIGS. 12 and 13.
Figure 15:
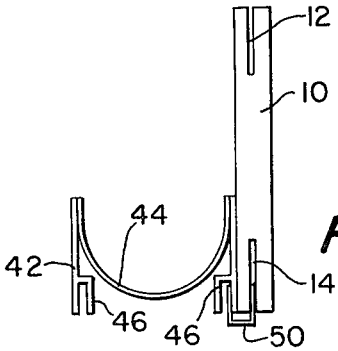
FIG. 15 is an end elevational view of tray member a tray member as connected to a runner member.

Referring to FIGS. 12 to 15, a system of storage trays are illustrated which can be utilized with the space divider arrangement of the invention. Two such trays are shown in FIG. 12 and, as illustrated, the trays include a pair of spaced side walls 42 and a central semi-circular tray portion 44. Generally L-shaped portions 46 of side walls 42 form slots 48 with the side walls. As shown in FIG. 13, by placing adjacent side walls in abutting relationship and using a U-shaped connector 50 shown in FIG. 14, the trays can be readily assembled into a unit by inserting the legs of the U into the two slots 48. Further, a tray can be readily connected to a runner member 10 using a U-shaped connector like that or similar to that of FIG. 14 (the width of the U-shaped connector might be different depending on the relative sizes of the tray and runner and the corresponding slots defined thereby).

Although the invention has been described relative to exemplary embodiments thereof, it will be understood that other variations and modifications can be effected in these embodiments without departing from the scope and spirit of the invention.

I claim:

1. A space dividing assembly for dividing a space so as to define a plurality of separate compartments, said assembly comprising:

a plurality of runner members of flat, generally rectangular shape and including longitudinal slots formed in the upper and lower edges thereof and extending along said edges; and a plurality of connector members for interconnecting said runner members together to form the space dividing assembly, each of said connector members including a generally planar body portion which extends parallel to and abutting an edge of a runner member and at least two generally planar flanges extending outwardly from said body portion on the same side of the connector member that abuts said edge of a runner member, said flanges engaging in the slots of juxtaposed ones of said runner members so as to connect juxtaposed runner members together; at least one of said connector members comprising a substantially T-shaped member comprising a said body portion comprising a T-shaped substantially planar base having a bar portion and a central leg portion, a first flange being joined along one edge thereof to the longitudinal edge of said bar portion away from said leg portion and extending perpendicularly to the plane of said base and a second flange extending perpendicularly to the plane of said base on the same side of said base as said first flange and orthogonally to said first flange, said first and second flanges of said T-shaped member being spaced apart in the area of joindure of said bar portion and said leg portion and said first and second flanges of said T-shaped member being received in respective slots of two juxtaposed runner members;

at least one further said connector member comprising a substantially L-shaped member comprising a said body portion comprising a substantially planar L-shaped base and first and second flanges being joined to and extending from a respective edge of the respective legs of said L-shaped base perpendicularly to the plane of the L-shaped base on the same side of said L-shaped base and orthogonal to each other, said first and second flanges of said L-shaped base being spaced apart in the area of joindure between the legs of said L-shaped base and being received in slots of two juxtaposed runner members.

2. An assembly as claimed in claim 1 wherein said assembly includes a bottom-forming member comprising a side portion and an integral bottom portion adjacent to said side portion along one edge thereof, said plurality of runner members being supported on said bottom portion and said side portion being substantially flat, having planar side walls and including a longitudinal slot in the edge thereof away from the edge adjacent to said bottom portion, said assembly further comprising a further connector component including means for connecting said further component to the inside wall of said side portion of said bottom-forming member and a coupling flange which engages in a said lower slot in a said runner member so as to connect said side portion to said runner member.

3. An assembly as claimed in claim 2 wherein a recess is provided in said side portion of said bottom-forming member in the lower inside surface thereof and wherein the connecting means of said connector component comprises a rod portion received in said recess.

4. An assembly as claimed in claim 1 further comprising a bottom member forming a support surface for a said runner member against which the end of the said runner member abuts and including an adjacent end surface, and an additional connector component comprising a generally L-shaped member comprising a pair of legs, one of said legs including an offset portion against which the end surface of the bottom member abuts and an end portion which engages in a said slot in the said runner member so as to connect said bottom member to the said runner member.

5. An assembly as claimed in claim 1 further comprising a wall member including a wall surface against which a said runner member abuts and a further end surface adjacent said wall surface and an additional connector component comprising a generally L-shaped member comprising a pair of legs, one of said legs including an offset portion against which the end surface of the wall member abuts and an end portion which engages in a said slot in said runner member so as to connect the wall member to said runner member.

6. An assembly as claimed in claim 1 wherein said assembly is disposed in an existing drawer.

7. An assembly as claimed in claim 6 wherein said assembly further comprises at least one wall connector component connecting the ends of a runner member to the inner walls of the drawer, said wall connector component comprising a backing portion adhesively securing the component to the wall and a pair of spaced centrally disposed flanges which engage in the respective slots in a said runner member.

8. An assembly as claimed in claim 7 wherein said wall connector component includes further flanges which are disposed on opposite sides of said runner adjacent the side walls thereof.

9. An assembly as claimed in claim 1 wherein said assembly further comprises at least one tray member including side walls and a central tray portion, said tray member being coupled to at least one of said runner members.

10. An assembly as claimed in claim 9 wherein the side walls of said tray member include means connected to said side walls and cooperating therewith to define a coupling slot and said assembly further comprises a U-shaped connector member which engages in said coupling slot and a said slot in said at least one runner member so as to couple the tray member to said at least one runner member.

11. An assembly as claimed in claim 10 wherein there are a plurality of said tray members, said assembly further comprising a U-shaped connector the legs of which are received in the coupling slots of adjacent side walls of two said tray members so as to connect said two tray members together.

* * * * *